US005117154A

United States Patent [19]

Thomas et al.

[11] Patent Number: 5,117,154

[45] Date of Patent: May 26, 1992

[54] METAL HALIDE DISCHARGE LAMP WITH IMPROVED SHANK LOADING FACTOR

[75] Inventors: Brian J. Thomas, Phoenix; Daniel C. Briggs, Camillus; Michael Avdenko, Skaneateles Falls, all of N.Y.

[73] Assignee: Welch Allyn, Inc., Skaneateles Falls, N.Y.

[21] Appl. No.: 636,742

[22] Filed: Dec. 31, 1990

[51] Int. Cl.[5] ..... H01J 17/16; H01J 61/30

[52] U.S. Cl. ..... 313/634; 313/284; 313/285; 313/631; 313/632; 313/44; 313/46

[58] Field of Search ..... 313/284, 285, 286, 290, 313/631, 632, 634, 570, 571, 46, 44

[56] References Cited

U.S. PATENT DOCUMENTS

| | | | |
|---|---|---|---|
| 3,263,852 | 8/1966 | Fridrich | 220/2.1 R |
| 3,305,289 | 2/1967 | Fridrich | 445/14 |
| 3,636,341 | 1/1972 | Miller | 362/263 |
| 3,714,493 | 1/1973 | Fridrich | 113/571 |
| 4,202,999 | 5/1980 | Holle et al. | 174/50.61 |
| 4,968,916 | 11/1990 | Davenport et al. | 313/631 |

FOREIGN PATENT DOCUMENTS

| | | | |
|---|---|---|---|
| 0051457 | 3/1983 | Japan | 313/634 |
| 0200455 | 10/1985 | Japan | 313/634 |

*Primary Examiner*—Donald J. Yusko
*Assistant Examiner*—Nimeshkumar D. Patel
*Attorney, Agent, or Firm*—Wall and Roehrig

[57] ABSTRACT

A low-wattage metal-halide discharge lamp has a quartz tube of the double-ended type that forms a bulb or envelope, a pair of electrodes, e.g., an anode and a cathode, which penetrate into an arc chamber inside the envelope, and a suitable amount of mercury plus one or more metal halide salts. The electrodes are each formed of a refractory metal, i.e., tungsten wire, extending through the respective necks into the arc chamber. Heat dissipation through the neck is controlled by constructing the quartz shanks to that they have shank segments of a desired surface area that extend from the necks a distance equal to the length of the arc chamber. A shank segment loading factor defined as the rated power divided by the shank segment surface areas, and should be in a target range of 12 to 36 w $cm^{-2}$. Lamps of this design achieve high efficacy at relatively low power, i.e., below 30 watts.

8 Claims, 2 Drawing Sheets

METAL HALIDE DISCHARGE LAMP WITH IMPROVED SHANK LOADING FACTOR

BACKGROUND OF THE INVENTION

The present invention relates to metal halide vapor discharge lamps, and is more particularly directed to lamps that have efficacies in excess of 35 lumens per watt, in some cases over 100 lumens per watt, but which operate at low to medium power, i.e., usually under 30 watts, but in some cases up to 40 watts. The present invention is more specifically concerned with quartz tube geometry which, in combination with the electrode structure and the mercury, metal halide, and noble gas fill, makes the high efficacy possible.

Metal halide discharge lamps typically have a quartz tube that forms a bulb or envelope and defines a sealed arc chamber, a pair of electrodes, e.g., an anode and a cathode, which penetrate into the arc chamber inside the envelope, and a suitable amount of mercury and one or more metal halide salts, such as NaI, or $ScI_3$, also reposed within the envelope. The vapor pressures of the metal halide salts and the mercury affect both the color temperature and efficacy. These are affected in turn by the quartz envelope geometry, anode and cathode insertion depth, arc gap size, and volume of the arc chamber. Higher operating temperatures of course produce higher mercury and metal halide vapor pressures, but can also reduce the lamp life cycle by hastening quartz devitrification and causing tungsten metal loss from the electrodes. On the other hand, lower operating temperatures, especially near the bulb wall, can cause salt vapor to condense and crystallize on the walls of the envelope, causing objectionable flecks to appear in objects illuminated by the lamp.

Many metal halide discharge lamps of various styles and power ranges, and constructed for various applications, have been proposed, and are well known to those in the lamp arts. Lamps of this type are described, e.g. in U.S. Pat. Nos. 4,161,672; 4,808,876; 3,324,332; 2,272,647; 2,545,884 and 3,379,868. These are generally intended for high-power applications, i.e., large area illumination devices or projection lamps. It has not been possible to provide a small lamp of high efficacy that could be used in a medical examination lamp or other application at a power of under 40 watts. No one has previously approached lamp building with a view towards applying heat management principles to produce a lamp that would operate a low power and high efficacy and would also develop sufficient mercury and metal halide vapor pressures within the arc chamber without causing devitrification and softening of the quartz tube envelope, and without causing damage to the tungsten electrodes.

OBJECTS AND SUMMARY OF THE INVENTION

It is an object of this invention to provide a low-power, high-efficacy metal-halide discharge lamp that avoids the drawbacks of such lamps of the prior art.

It is more specific object to provide a metal-halide discharge lamp that enjoys reasonably long life while delivering light at a efficacies exceeding 35 lumens per watt.

It is a still more specific object to provide bulb geometry that permits effective management of heat flow from the arc chamber and dissipation from the shanks of the lamp, and thus promotes high-efficacy illumination at low power input.

In accordance with an aspect of the present invention, the lamp has a tube envelope of the double-ended type having a first neck on one end and a second neck on an opposite end of a bulb. There are suitable quantities of mercury and metal halide salt or salts contained within the bulb. The bulb wall defines a cavity or arc chamber that extends from neck to neck to contain the metal halide salt vapors and mercury vapor during operation. First and second elongated electrodes formed of a refractory metal, i.e., tungsten wire, extend through the respective necks into the arc chamber. These electrodes are aligned axially so that their tips define an arc gap between them of a suitable arc length.

The bulb wall thickness increases gradually from a midchamber plane, i.e., from a plane midway between the two necks, to the respective necks. The wall is formed with an appropriate thickness relative to the lamp's rated power or wattage.

The necks are constricted somewhat to achieve an optimal heat flow rate into the shanks so that high efficacy can be achieved.

Each shank has a respective shank segment defined as the part of the shank that extends from the respective neck a distance equal to the arc chamber length. It is over these shank segments that thermal energy that is conducted out the necks of the lamp is dissipated (mostly by conduction and convection) to the environment. These shank segments are dimensioned to keep their surface areas are limited relative to the lamp's rated power, such that there is a shank section loading within a desired target range. The shank segment loading factor is equal to the lamp's rated power divided by the sum of the surface areas of the first and second shank segments, and this factor should be in a range of about 16 to 36 watts per square centimeter. If the shank segment loading is too low, too much heat is dissipated out through the shanks, and if it is too high, damage to the bulb wall and to the tungsten electrodes can result. In the case of a very low wattage lamp, it may be difficult to constrict the necks significantly because of the small dimensions of the bulb. Thus, target shank segment loading can be achieved with shanks that are less constricted at the necks but which increase gradually in diameter over, or beyond, the required axial distance. For higher power lamps, care should be also taken to provide enough surface area to permit adequate heat dissipation.

Lamps of this design can operate at very low power (2 to 5 watts), low power (5 to 14 watts), or intermediate power (14 to 30 watts), depending on the intended application, and in each case with a high efficacy. The efficacy can exceed 100 lumens per watt in some cases.

The narrow size of the lead-in wire portion of the electrode prevents thermomechanical stressing of the quartz of the neck, which has a thermal coefficient of expansion quite different from tungsten.

Preferably, the chamber has flared regions where the necks join the bulb, so that there is an extended region, of very small volume, where each lead-in wire is out of direct contact with the quartz (or equivalent material) as the electrode. This feature facilitates condensation of salt reservoirs at the neck behind one or the other of the electrodes and also facilitates control of heat flow from the hot electrodes out into the shanks of the lamp.

The foregoing and other objects, features, and advantages of the invention will be more fully appreciated from the ensuing detailed description of selected preferred embodiments, to be considered in conjunction with the accompanying Drawing.

DETAILED DESCRIPTION OF THE PREFERRED EMBODIMENT

Figure 1:
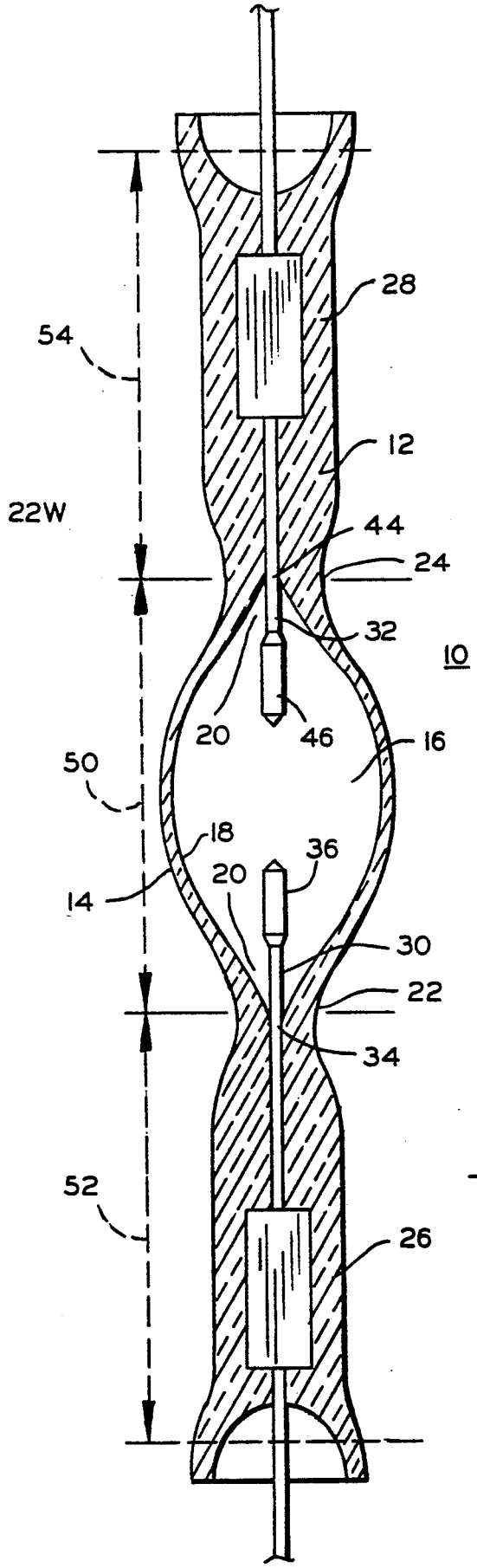
FIG. 1 is a elevational view of a quartz metal halide discharge lamp according to one embodiment of this invention.

With reference to the Drawing, and initially to FIG. 1, a twenty-two watt lamp 10 comprises a double-ended fused quartz tube 12 which is formed by automated glass blowing techniques. The tube has a thin-wall bulb 14 at a central portion defining within it a cavity or chamber 16. In this case, the chamber is somewhat lemon shaped or gaussian shaped, having a central convex portion 18, and flared end portions 20 where the bulb 14 joins the first and second necks 22, 24, respectively. As illustrated, the necks 22 and 24 are each narrowed-in or constricted, which limits heat flow out into the respective first and second shanks 26 and 28.

There are first and second electrodes 30 and 32, each supported in a respective one of the necks 22, 24. Here, the electrodes are formed of a refractory metal, e.g. tungsten, and are of a "composite" design, that is, more-or-less club shaped.

The first electrode 30, which serves as anode, has a lead-in tungsten wire shank 34 that is supported in the neck 22 and extends somewhat into the chamber 16 where a tungsten post portion 36 is butt-welded onto it. The lead-in wire is of rather narrow gauge, typically 0.007 inches, and the post portion is of somewhat greater diameter, typically 0.012 inches. The post portion 36 has a conic tip which forms a central point with a flare angle in the range of 60 degrees to 120 degrees.

The tungsten lead-in wire 34 extends through the quartz shank 26 out to a molybdenum foil seal which connects with a molybdenum lead-in wire that provides an electrical connection to the positive terminal of an appropriate ballast (not shown).

Likewise, cathode electrode 32 has a tungsten lead-in wire 44 that extends in the shank 28 and is supported in the neck 24. The wire 44 extends somewhat out into the chamber 16 and a post portion 46 is butt-welded onto it. The cathode post portion 46 has a pointed, conic tip with a taper angle on the order of 30 to 45 degrees. Here the wire 44 is typically of 0.007 inches diameter while the post portion can be, e.g., of 0.012 inches diameter. The lead-in wire 44 extends to a molybdenum foil seal that connects to an inlead wire.

The post portions 36, 46 of the anode and cathode are supported out of contact with the necks 22, 24, and out of contact with the walls of the bulb 14. The specific electrode structure is described in commonly assigned copending U.S. patent application Ser. No. 07/636,743, filed Dec. 31, 1990; and the description there is incorporated here by reference.

The anode 30 and the cathode 32 are aligned axially, and their tips define between them an arc gap in the central part of the chamber 16.

The post portions have a rather large surface area that is in contact with the mercury and metal halide vapors in the lamp, so the heat conducted away from the pointed tips is largely transferred to the vapors in the chamber.

While not shown in this view, the lamp 10 also contains a suitable fill of a small amount of a noble gas such as argon, mercury, and one or more metal halide salts such as sodium iodide. The particular metal salts selected, and their respective proportions, depend on the optical discharge characteristic of the metal ions in relation to the desired wavelength distribution for the lamp.

The lead-in wires for he electrodes, being made of tungsten, have about 90 to 96 times higher coefficient of heat conductivity than does the quartz material of the tube 12. Therefore, it is desirable to keep the lead-in wires 34, 44 as small in diameter as is possible. The smaller-diameter lead-in wire portions of the electrodes will experience only a relatively small amount of thermal expansion due to heating of the tungsten wire. This occurs for two reasons: The smaller-diameter wire does not carry nearly as much heat up the respective necks as if electrodes the size of the post portions continued up to the necks. Secondly, the amount of thermal expansion is proportional to the over-all size; thus where the size is kept small, stresses due to thermal expansion are also kept small. Because of this, the construction principles employed here present a reduced risk of cracking of the fused quartz due to the differential thermal expansion of the quartz and tungsten materials.

As is also shown in FIG. 1, the thickness of the wall of the bulb 14 increases gradually from a center or mid-plane that is perpendicular to the lamp axis and is midway between the two necks 22 and 24. The wall thickness is kept within limits based on the lamp wattage and bulb dimensions, so as to regulate thermal conductive heat flow along the quartz bulb wall from the zone near the arc gap towards the first and second shanks 26 and 28.

As also shown in FIG. 1, each of the neck 22, 24 is constricted at a position that corresponds to the plane at which the respective electrode 30, 32 leaves the neck and enters the chamber 16. The necks define a limited cross sectional area for the quartz tube 12.

As shown in FIG. 1, the bulb 14 has a chamber length 50 equal to the distance within the lamp from the first neck 22 axially to the second neck 24. Each of the first and second shanks 26 and 28 has a respective shank segment 52 and 54, which is defined as the part of the shank that extends outward axially from the respective neck 22, 24 a distance equal to the chamber length 50. Because of the constrictions at the necks, these shank segments 52 and 54 have surface areas that are somewhat smaller than the corresponding surfaces of the cylindrical tube without the constriction (i.e., as in the prior art). The dimensions of the shank segments 52, 54 are controlled during the formation of the lamp so that the shank segments have desired surface area selected in relation to the rated power of the lamp. The lamps of this invention have a shank segment loading factor defined as the lamp rated power divided by the sum of the surface areas for the two shank segments, and this should be in a range of 12 to 36 watts per square centimeter. In the case of the illustrated embodiment, which is a twenty-two watt lamp, the shank segment loading factor is approximately 24 w $cm^{-2}$.

Figure 2:
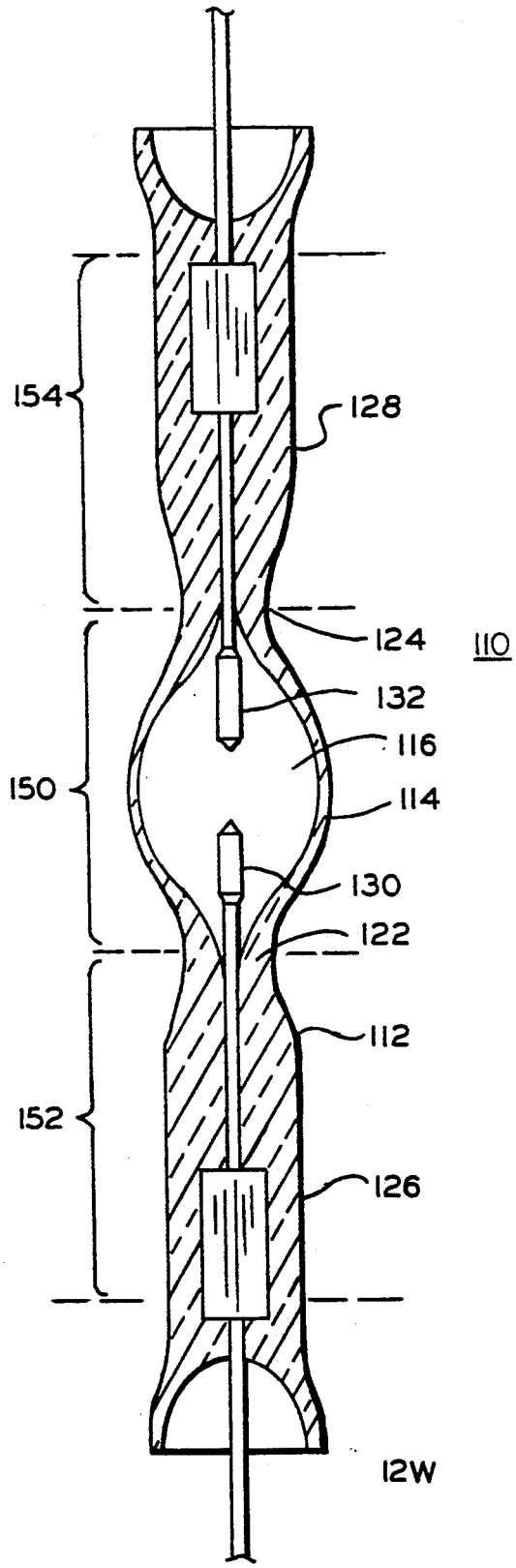
FIGS. 2 and 3 are elevational views of other lamps that embody this invention.

FIG. 2 shows another lamp 110 of this invention, here of intermediate power, that is, between about five and fifteen watts. The same considerations as discussed above are taken into account in the design and construction of this lamp, and elements that correspond to elements in the previously described embodiment employed the same reference numbers, but raised by 100.

Here, the lamp 110 has a double-ended fused quartz tube 112, with a bulb 114 whose wall defines an arc chamber 116 that contains a fill of mercury, a halogen salt, and a small quantity of a noble gas. There are first and second constricted necks 122 and 124 through which first and second electrodes 130 and 132 enter the chamber 116. As in the first embodiment, there are a first shank 126 and a second shank 128. First and second shank segments 152 and 154 extend from the respective necks a distance equal to the chamber length 150. The shank segment loading factor is determined, as described previously, from the rated power of the lamp and the surface areas of these shank segments 152 and 154.

The shank segment loading factor should be maintained within the range of 12 to 36 watts per square centimeters. In the embodiment, which is a twelve-watt lamp, the load factor is about 18 w $cm^{-2}$.

Figure 3:
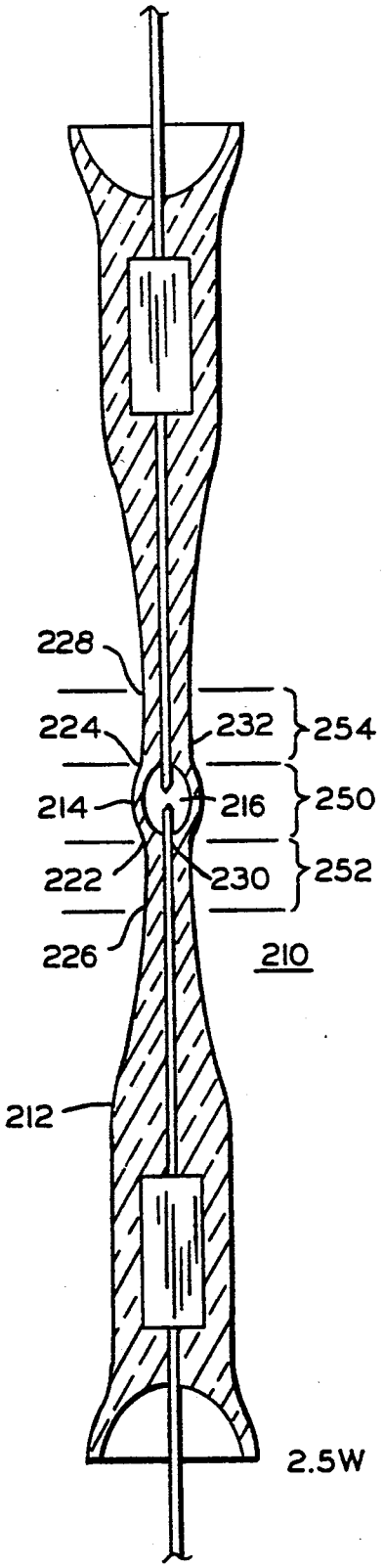

A very low power lamp 210 of this invention is shown in FIG. 3, the lamp having a rated power of under five watts. Here the same design consideration are employed as in the previous embodiments, and a high efficacy is achieved of 40 lumens per watt or higher. Elements that correspond to those of the first embodiment are identified with the same reference characters, but raised by 200. Here, there is a fused quartz tube 212 with a correspondingly smaller bulb 214 formed therein with a wall that defines an arc chamber 216 of chamber length 250 and where there is a suitable fill of mercury salt, and a noble gas. Through first and second constricted necks 222 and 224 at either end of the bulb there emerge first and second tungsten wire electrodes 230 and 232. These define a small arc gap within the chamber 216. Here, the electrodes 230, 232 are of uniform diameter wire, rather than of composite design as employed in the lamp of FIGS. 1 and 2. First and second shanks 226 and 228 each have a respective shank segment 252 and 254 that is defined as extending from the respective neck a short distance equal to the chamber length 250. In this case because of the very small dimensions of the bulb 214, it is difficult to choke the two necks 222, 224 to form constrictions of a similar shape to those of the other embodiments.

Rather, a reduced heat dissipation characteristic is achieved by reducing the diameters of the shanks 226 and 228 over a significant distance from the necks 222 and 224. In this way, there is a gradual taper over the entire shank segment, yielding a shank segment surface loading factor in the target range of 12 to 36 watts per square centimeter. The depicted lamp, which has a rated power of about 2.5 watts, has a shank segment loading factor of about 24 w $cm^{-2}$. Controlling of shank segment surface loading is especially useful in these small lamps, and can be achieved by controlling the shank or stem taper angle.

In each of the larger lamps (15 to 40 watts), intermediate lamps (5 to 14 watts) and smaller lamps (under 5 watts), heat management principles are employed to limit the flow of heat along the quartz wall of the bulb and out the necks onto large radiating surfaces to the shanks, and to limit the size of those surfaces. Hot turbulent gases in the zones between the electrode tips, i.e., in the vicinity of the arc-generated plasma, perform most of the heat transfer function in the central part of the chamber. However, as heat proceeds axially towards the necks, the conductivity in the quartz bulb wall and in the shanks plays a greater factor. The rate of heat dissipation should be kept within a target range so that temperature remains high enough to keep mercury and salt vapor pressures high. However, some minimum dissipation of heat is necessary to keep high temperatures from devitrifying the fused quartz bulb wall. Also, excess salt, i.e., a salt reservoir, should condense at an area that is disposed away from the central part of the bulb wall; in this invention the coolest part of the chamber in the operating lamp is at one of the necks behind the electrode, so that the salt reservoir forms there. Thus, flecks of condensed salt do not form on the convex portion 18 of the bulb wall in the path of illumination.

The necks, bulb side walls, and shanks of the quartz tube are required to be thick enough for structural support, and to transfer sufficient heat to prevent devitrification, while being dimensioned small enough for retaining heat to produce the high vapor pressures that result in high lamp efficacy and desired color temperatures at the low rated power levels employed.

While this invention has been described in detail with reference to selected preferred embodiments, it should be understood that the invention is not limited to those precise embodiments. Rather, many modifications and variations would present themselves to those of skill in the art without departing from the scope and spirit of this invention, as defined in the appended claims.

What is claimed is:

1. A metal halide discharge lamp that includes a tube envelope of a double-ended type having a first neck and second neck axially arranged on opposite ends of a bulb and each respective neck joining a first shaft and a second shaft to the bulb which has a bulb wall that defines an arc chamber which has a chamber length defined by the distance between said necks, predetermined quantities of mercury and a metal halide salt within said chamber, and first and second elongated electrodes of a refractory metal each extending axially through a respective shaft and emerging at a respective one of said necks into said arc chamber, the electrodes having axial tips spaced apart to define an arc gap therebetween, said lamp having a rated power about 40 watts or below that depends on said chamber volume, the quantities of mercury and salt in the chamber, and the arc gap; and wherein each said shaft has a respective shaft segment surface area over a segment of the shaft that extends from the respective neck a distance equal to the length of the arc chamber, wherein said lamp has a rated shaft segment loading factor equal to the rated power of the lamp divided by the sum of the first and second shaft segment areas, said shaft segment loading factor being in the range of 12 to 36 watts per square centimeter.

2. A metal halide discharge lamp according to claim 1 wherein said rated power is between about 2 watts and 5 watts.

3. A metal halide discharge lamp according to claim 2 in which the shaft segments increase in diameter gradually from the respective necks axially outward over said length equal to said arc chamber length.

4. A metal halide discharge lamp according to claim 1 wherein said rated power is between about 5 watts and 30 watts.

5. A metal halide discharge lamp according to claim 4 in which the shaft segments increase gradually in diameter from the respective necks axially outward for a significant portion of said length equal to said arc chamber length.

6. A metal halide discharge lamp according to claim 5 wherein said rated power is between about 15 watts and 30 watts.

7. A quartz halogen lamp according to claim 5 wherein said rated power is between about 5 watts and 14 watts.

8. A metal halide discharge lamp according to claim 1 wherein said bulb wall has a wall thickness that increases gradually from a plane midway between the necks to the respective first and second necks.

* * * * *